US006724279B1

(12) United States Patent
Kitajima et al.

(10) Patent No.: US 6,724,279 B1
(45) Date of Patent: Apr. 20, 2004

(54) DUPLEXER FILTER WITH OFFSET RESONATOR HOLES

(75) Inventors: Masahiko Kitajima, Ube (JP); Kosuke Nishimura, Ube (JP); Hiroshi Nakamura, Ube (JP)

(73) Assignee: Ube Electronics, Ltd., Mine (JP)

( * ) Notice: Subject to any disclaimer, the term of this patent is extended or adjusted under 35 U.S.C. 154(b) by 0 days.

(21) Appl. No.: 09/677,631

(22) Filed: Oct. 3, 2000

(51) Int. Cl.[7] ..... H01P 1/213; H01P 1/205
(52) U.S. Cl. ..... 333/134; 333/202; 333/206
(58) Field of Search ..... 333/206, 202, 333/202 DB, 134

(56) References Cited

U.S. PATENT DOCUMENTS 5,488,335 A * 1/1996 Agahi-Kesheh et al. .... 333/206
5,675,301 A * 10/1997 Nappaet et al. ..... 333/206 X
5,864,264 A * 1/1999 Hino ..... 333/206

* cited by examiner

*Primary Examiner*—Benny Lee
(74) *Attorney, Agent, or Firm*—Salans; Maxim H. Waldbaum, Esq.; Kimberly K. Weate

(57) ABSTRACT

A filter with an equivalent circuit that functions as well as physically larger filters without substantial drop off in performance.

16 Claims, 11 Drawing Sheets

DUPLEXER FILTER WITH OFFSET RESONATOR HOLES

FIELD OF THE INVENTION

This invention enables development and production of high electrical performance filters in sizes much smaller than what is capable with existing technologies, using an improved equivalent circuit.

BACKGROUND OF THE INVENTION

A ceramic body with a coaxial hole bored through its length forms a resonator that resonates at a specific frequency determined by the length of the hole and the effective dielectric constant of the ceramic material. The holes are typically circular, or elliptical. A dielectric ceramic filter is formed by combining multiple resonators. The holes in a filter must pass through the entire block, from the top surface to the bottom surface. This means that the depth of hole is the exact same length as the axial length of a filter. The axial length of a filter is set based on the desired frequency and available dielectric constant of the ceramic.

The ceramic block functions as a filter because the resonators are coupled inductively and/or capacitively between every two adjacent resonators. These components are formed by the electrode pattern which is designed on the top surface of the ceramic block couplings and plated with a conductive material such as silver or copper.

Ceramic filters are well known in the art and are generally described for example in U.S. Pat. Nos. 4,692,726, 4,823,098, 4,879,533, 5,250,916 and 5,488,335, all of which are hereby incorporated by reference as if fully set forth herein.

With respect to its performance, it is known in the art that the band pass characteristics of a dielectric ceramic filter are sharpened as the number of holes bored in the ceramic block are increased. The number of holes required depends on the desirable attenuation properties of the filter. Typically a simplex filter requires at least two holes and a duplexer needs more than three holes. This is illustrated in FIG. 9 where graph 10 represents the filter response with fewer holes than graphs 12 and 14. It is apparent that graph 14 which is the response of the filter with the most holes, is the sharpest of the three responses shown. Referring to FIG. 10, it can be seen that the band pass characteristic of a particular dielectric ceramic filter is also sharpened with the use of trap holes bored into the ceramic block. Solid line graph 21 represents the response of a filter without a high end trap. Dashed line graph 23 represents the response of the same filter with a high end trap.

Trap holes, or traps as they are commonly referred to, are resonators which resonate at a frequency different from the primary filter holes, commonly referred to simply as holes. They are designed to resonate at undesirable frequencies. Thus, the holes transmit signals at desirable frequencies while the traps remove signals at the undesirable frequencies, whether low end or high end. In this manner the characteristic of the filter is defined, i.e. high pass, low pass, or band pass. The traps are spaced from holes a distance greater than the spacing between holes so as to avoid mutual interference between the holes and traps. As shown in FIG. 11, whereas holes 31 are separated from each other a distance equal to D, a distance of 2D is placed between trap 33 and the transmission hole nearest to trap 33. The precise distance between trap and transmission pole is one of design choice for achieving a specified performance, but it is preferably 1 to 10 mm. Traditionally, the traps will be spaced from 1.5D to 2D from the holes.

Conventionally the holes 41 and traps 43 in a ceramic filter are positioned along a straight line. This design together with the spacing requirements addressed above limits the extent to which a filter may be reduced in size. Specifically, the performance characteristics of a given filter are a function of its width, length, number of holes and diameter of holes. The usual axial length L is 2 to 20 mm. The width w is determined by the number of holes. The usual width of the block filter is 2 to 70 mm. Reducing the number of holes, the diameter of the holes, or the spacing between holes, will effect the performance. Accordingly, it is desirable to have a design for a dielectric ceramic filter which can effectively reduce the size of a given filter while maintaining its given performance characteristics.

Equivalent circuits are generally those circuits with the same overall current, impedance, phase, and voltage relationships as a more-complicated counter part that it usually replaces.

There is a need for dielectric ceramic filters used in advanced communication applications such as CDMA and TDMA cellular phones with higher electrical performances and a smaller physical size. However the existing methods to develop a filter with higher electrical performance is to add additional transmission poles and/or trap resonators in a filter, which causes an increase in the size of the new filter.

SUMMARY OF THE INVENTION

This invention describes a new design for increasing the electrical performance without increasing the size of a high performance ceramic filter. To achieve this purpose, this invention describes a new equivalent circuit of dielectric ceramic filter with a new printed pattern on the filter to realize the new equivalent circuit.

DETAILED DESCRIPTION OF THE INVENTION

Figure 1:
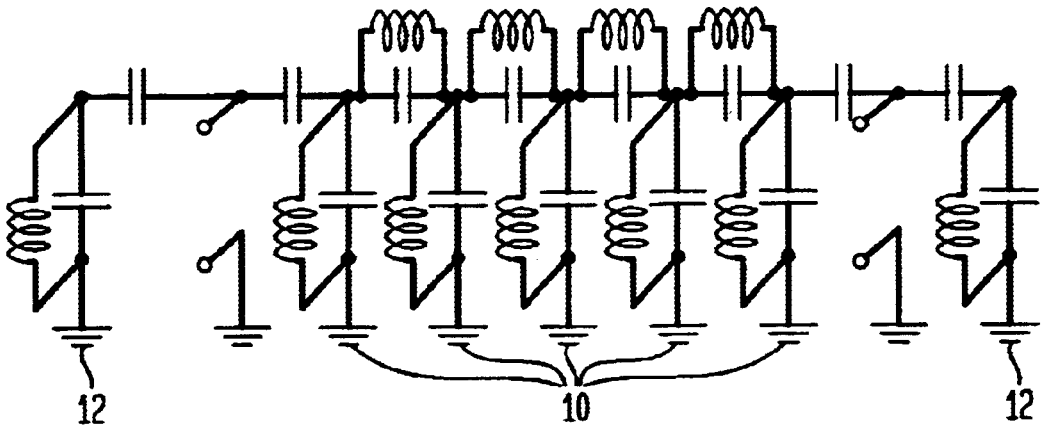
FIG. 1 (PRIOR ART)
FIG. 1 depicts a typical equivalent circuit of a prior art filter.
Figure 2:
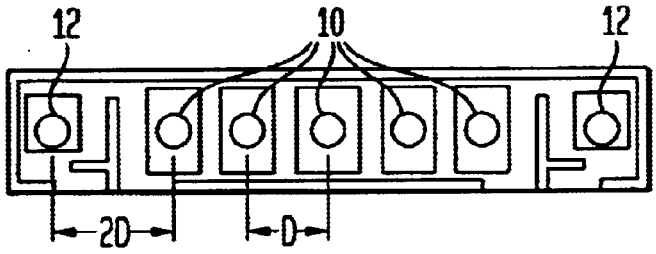
FIG. 2 (PRIOR ART)
FIG. 2 illustrates the typical printed pattern of a prior art filter designed in accordance with the equivalent circuit of FIG. 1.

In prior art filters, as shown in FIGS. 1 and 2, transmission holes 10 are separated from each other a distance equal to D (FIG. 2) and a distance of 2D (FIG. 2) is placed between trap holes 12 and the nearest transmission hole 10. The precise distance is a design choice for acheiving a specific performance. However, the need for trap holes with their requisite spacing requirements in a filter adds a significant constraint to the degree to which the filter can be made smaller.

Figure 4A:
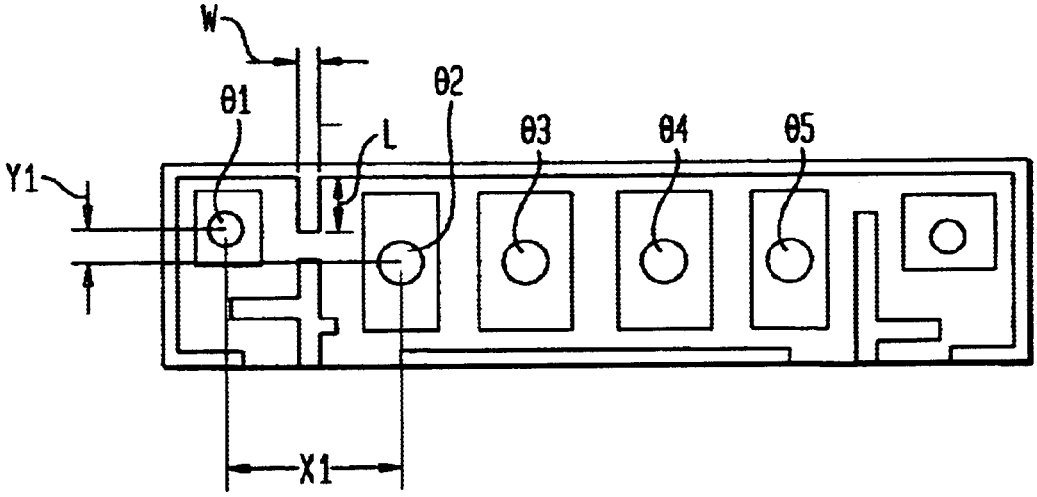
FIGS. 4A–4B illustrate one preferred embodiment of a printed pattern for a filter designed to perform as the equivalent circuit of FIG. 3.
Figure 4B:
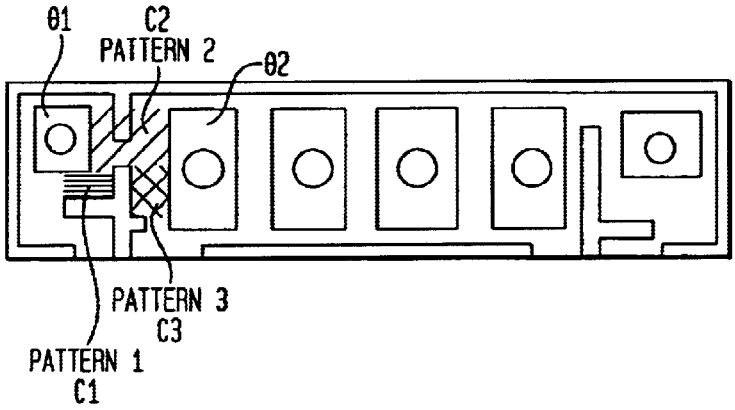

One embodiment of the invention is a filter with 4 transmission poles and 2 trap resonators (total 6 holes), shown in FIGS. 4A–4B. Capacitances C1, C2 and C3 are shown in FIG. 4B.

C1 is the capacitance of coupling between input/output electrode and resonator θ1; C2 is the capacitance of coupling between θ1 and θ2; and C3 is the capacitance of coupling between input/output electrode and resonator θ2. Z is the inductance of coupling between θ1 and η2. The shaded portion of the electric pattern, weakens C2. As a result of the weakened C2, Z is relatively strengthened.

Resonator θ1 functions as a transmission pole by the coupling of Z and C2, so that θ1 can compose 5 transmission poles by cooperation with the other 4 transmission poles of θ2, θ3, θ4 and θ5. (See FIG. 3).

Furthermore, θ1 also functions as a trap resonator by adjusting the coupling of C1, C2 and C3 as to be C1>C3>C2. Thus, θ1 can work as both a transmission pole and a trap resonator. Due to the unique pattern of the filter, θ1 can act as both a trap resonator and transmission pole, thus reducing filter size by eliminating one transmission pole. (See FIGS. 3 and 4A).

This means higher electrical performance can be achieved while having a smaller filter size by using this new design of equivalent circuit.

A new electrode pattern of conductive material was developed, as shown in FIGS. 4A and 4B to realize the effect of the new equivalent circuit. Each value of W, L, X1 and Y1 in FIG. 4A are the following ranges.

W: 0.5 mm≧W≧0.1 mm

L: 3.0 mm≧L≧0.5 mm

X1: 4.0 mm≧X1>1.0 mm

Y1: 2.0 mm≧Y1≧0 mm

Figure 3:
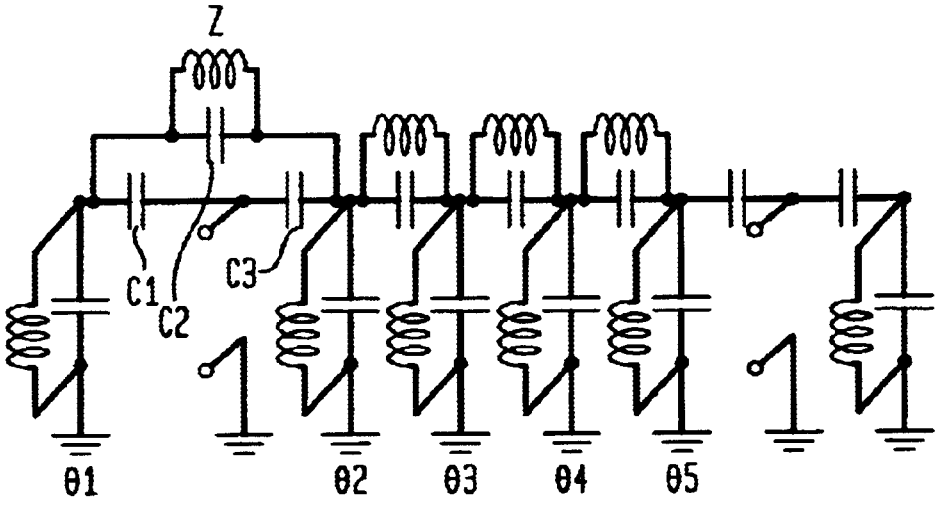
FIG. 3 illustrates the equivalent circuit for a filter designed in accordance with the present invention. This new equivalent circuit design has a similar electronic performance as the prior art filter of FIG. 1, but is physically smaller.

FIG. 4B shows parameters C1, C2 and C3. C1 is controlled by the distance between pattern 1 of conductive material for input/output electrode and pattern 3 of conductive electrode connected to conductive material on the inner surface of hole of θ1 resonator (FIG. 3), and C3 is controlled by the distance between pattern 1 and pattern 3 of conductive material connected to conductive material on the inner surface of hole θ2 resonator (FIG. 3). C1, C2 and C3 are capacitances of coupling as described above in FIG. 4B. Z is an inductive coupling and is controlled by the pattern 2 of conductive material that is opposed to the pattern 1 and is connected to the conductive material on the side wall. The relationship of C1, C2 and C3, to each other is as follows, C1>C3>C2.

Figure 5:
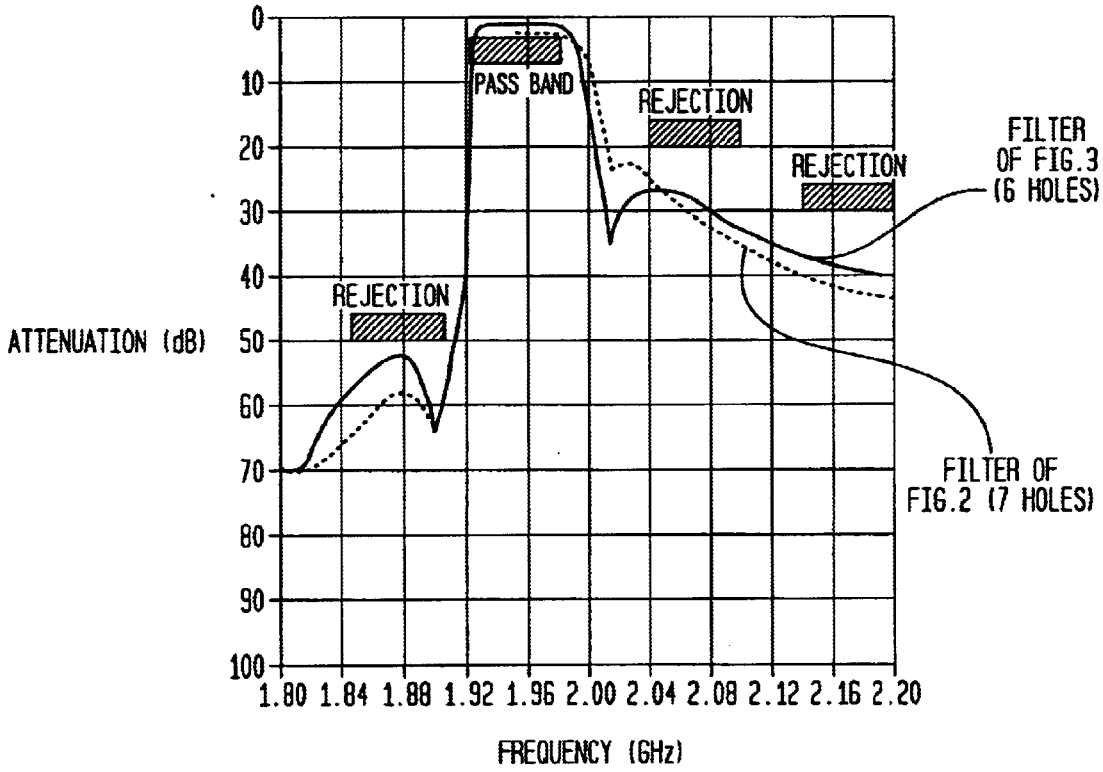
FIG. 5 compares the similarity in electrical performance between the filter designed in accordance with the present invention shown in FIG. 3 and a prior art filter, as shown in FIG. 1.

FIG. 5 shows the electrical data of the filters developed by the existing technology and by our new technology along with the requested specification. Although the present invention's filter is smaller, due to the less amount of holes, than currently available filters, its performance matches the electrical performance of larger filters using presently available technology. The electrical performance of the present invention (the filter of FIG. 3) is represented by the rigid lines as is shown in FIG. 5. The electrical performance of a prior art filter (the filter of FIG. 2) is represented by the broken line as shown in FIG. 5.

Figure 6:
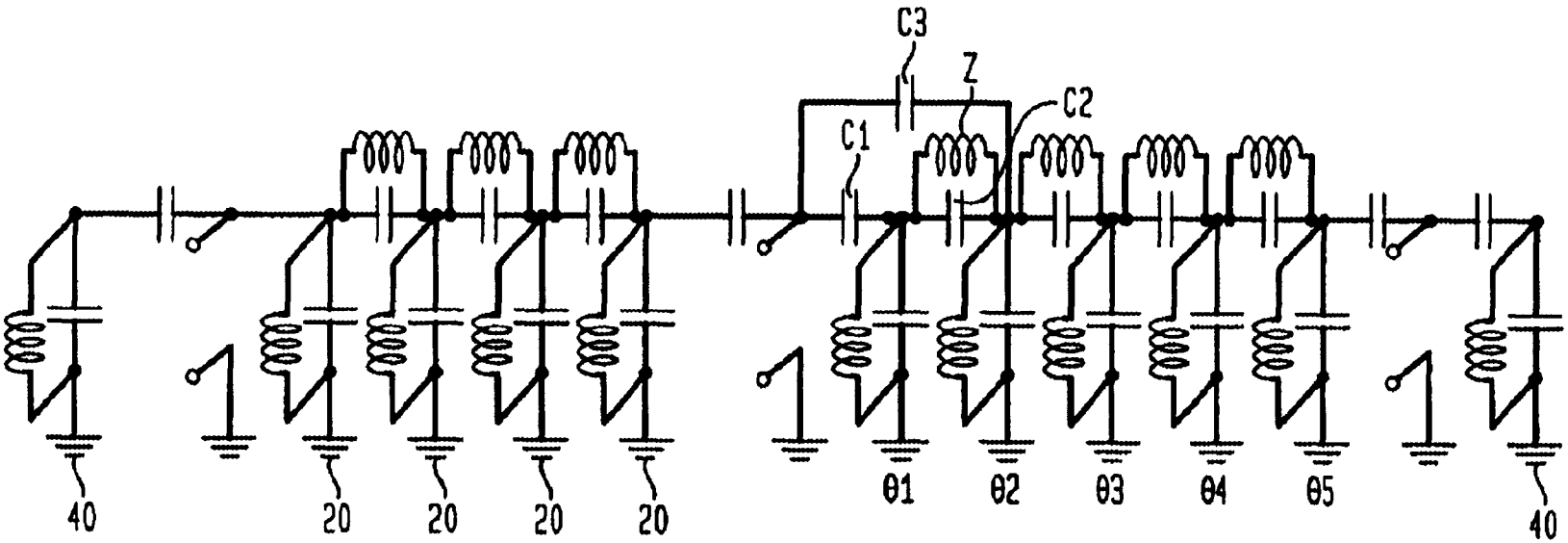
FIG. 6 illustrates the equivalent circuit for a duplexer designed in accordance with another embodiment of the present invention.
Figure 7A:
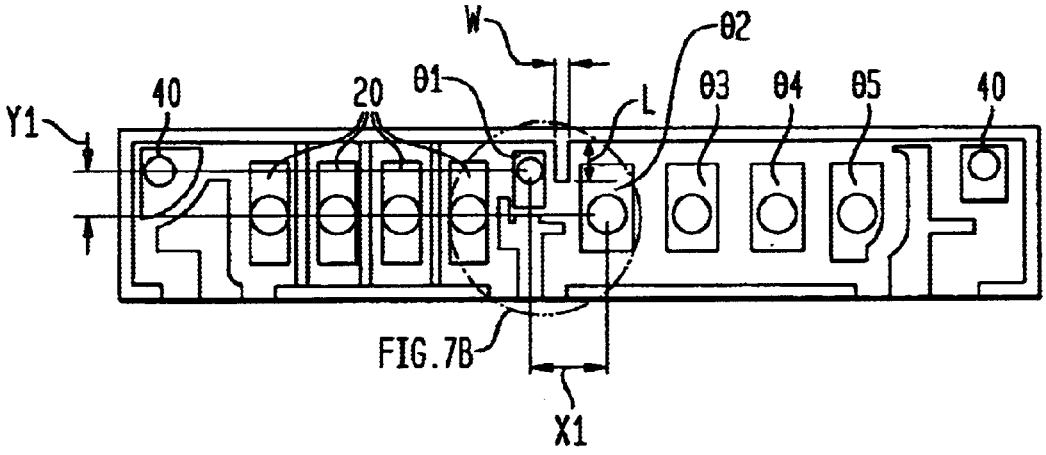
FIGS. 7A–7B illustrates one preferred embodiment of a printed pattern for a duplexer designed to perform as the equivalent circuit of FIG. 6.
Figure 7B:
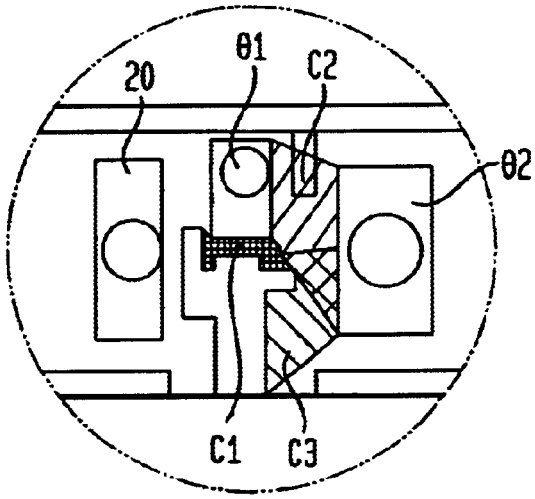

We can also apply the concepts of this new filter technology to a duplexer. FIGS. 7A–7B is an embodiment of a printed pattern duplexer of the present invention. FIG. 6 is its equivalent circuit for a duplexer designated in accordance with another embodiment of the present invention. FIG. 6 and FIGS. 7A–7K show examples of new equivalent circuits and printed patterns, as applied to a duplexer. The duplexer of FIG. 6 and FIGS. 7A–7B has eight (8) transmission poles including four (4) transmission poles 20, four (4) transmission poles, θ2, θ3, θ4 and θ5, and three (3) trap resonators, including trap resonators 40 on each end of the duplexer and trap resonator θ1, but it can work as a filter with nine (9) transmission poles, and three (3) trap resonators, in which θ1 serves as both a transmission pole and a trap resonator. In most cases, the higher band is the receiver band and the lower band is the transmitter band at the mobile phone terminal sides. These designations become reversed at the base station sides. However, it is noted that the relationship of the receiver band and the transmitter band, on the one hand, and the higher/lower bands on the other hand are not always consistent.

Each value of W, L, X1 and Y1 for the duplexer filter are the following ranges.

W: 0.5 mm≧W≧0.1 mm

L: 3.0 mm≧L>0.5 mm

X1: 4.0 mm≧X1≧1.0 mm

Y1: 2.0 mm≧Y1≧0 mm

The relationship of C1, C2 and C3, to each other is as follows, C1>C3>C2. C1, C2 and C3 are shown on FIG. 7B.

In particular, FIGS. 7C, 7D, 7E, 7F, 7G, 7H, 7J, and 7K allow for the concept of a resonator θ1 working as both a transmission pole and as a trap resonator. Such a resonator θ1 allows for a duplexer that requires minimal space. The resonator θ1 acts as a transmission pole and as a trap resonator because of the unique relationship between the capacitances of capacitance couplings C1, C2 and C3, in the manner as is described for FIGS. 4B and 7B above. The unique pattern of the duplexers allows for the resonator θ1 to act as both a trap resonator and a transmission pole. In particular, FIGS. 7C, 7D, 7E, 7F, 7G, 7H, 7J, and 7K show that using the inventive patterns taught in the present application, one may vary the number of transmission poles and trap holes as desired and still obtain a duplexer that is smaller in size than traditional duplexers because of a resonator acting as a trap hole and trap resonator.

Figure 7C:
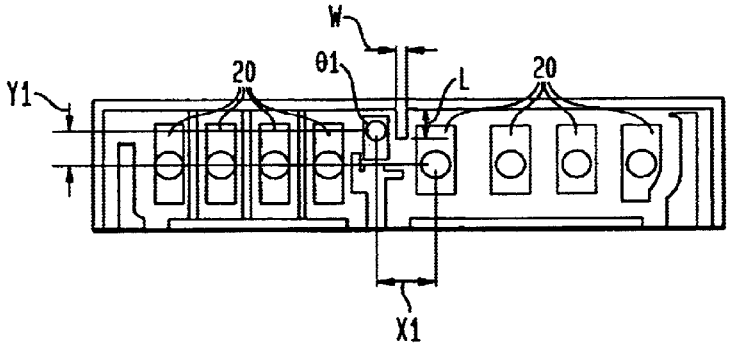
FIGS. 7C–7D, 7E–7G, 7G–7H and FIGS. 7J–7K and additional preferred embodiments and their equivalent circuits.
Figure 7D:
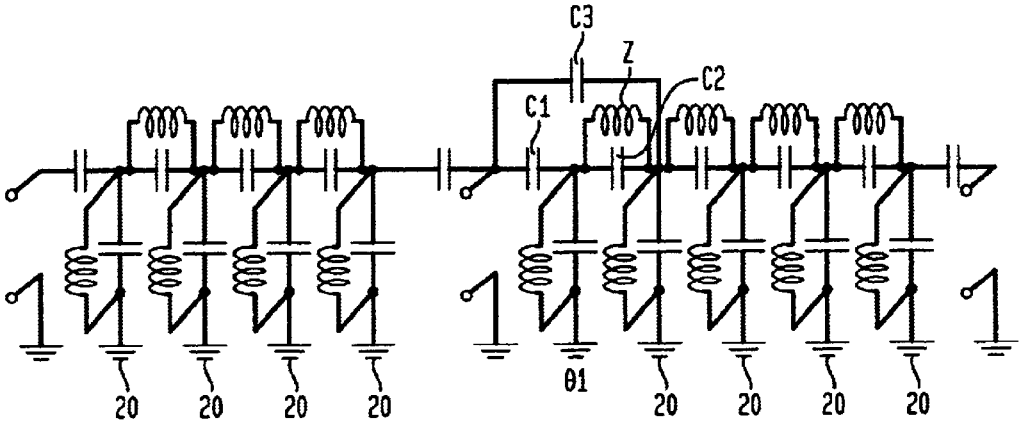
Figure 7E:
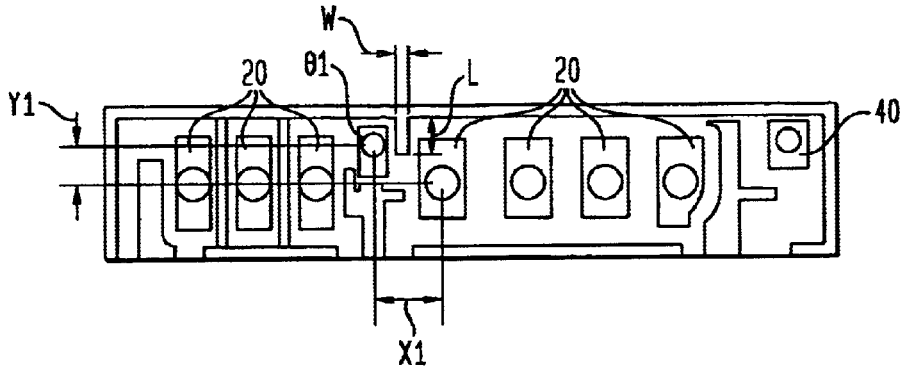
Figure 7F:
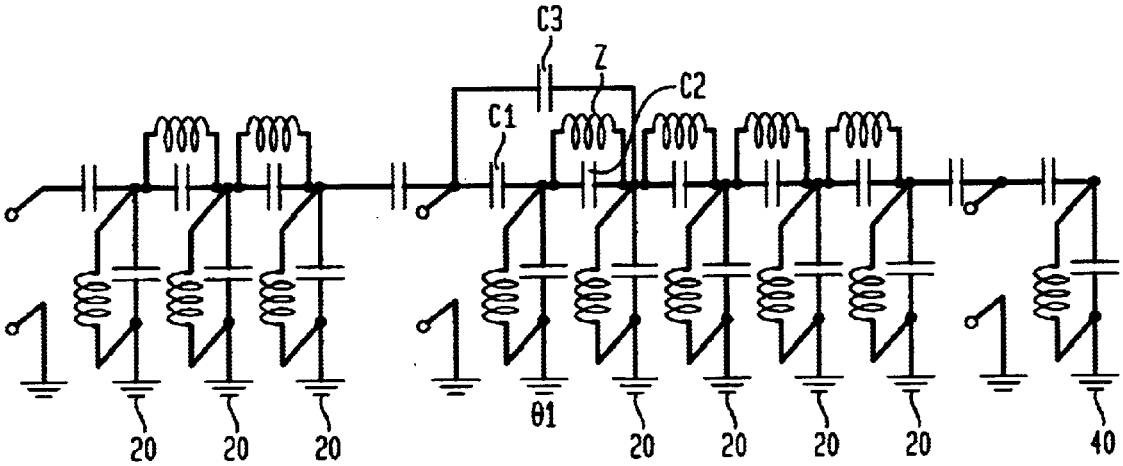
Figure 7G:
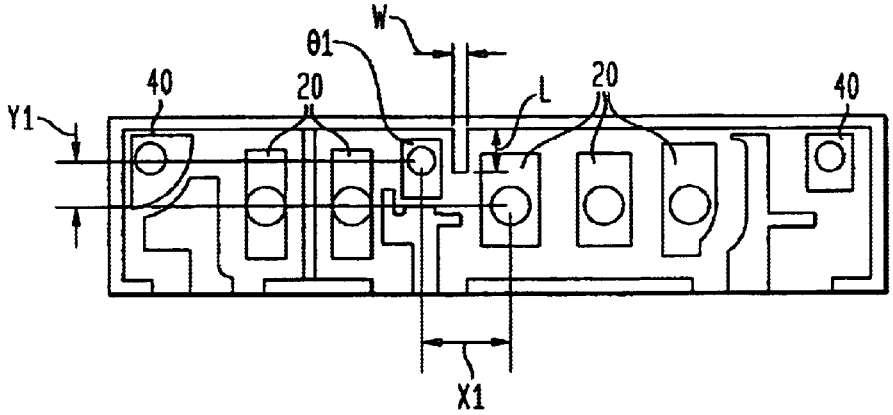
Figure 7H:
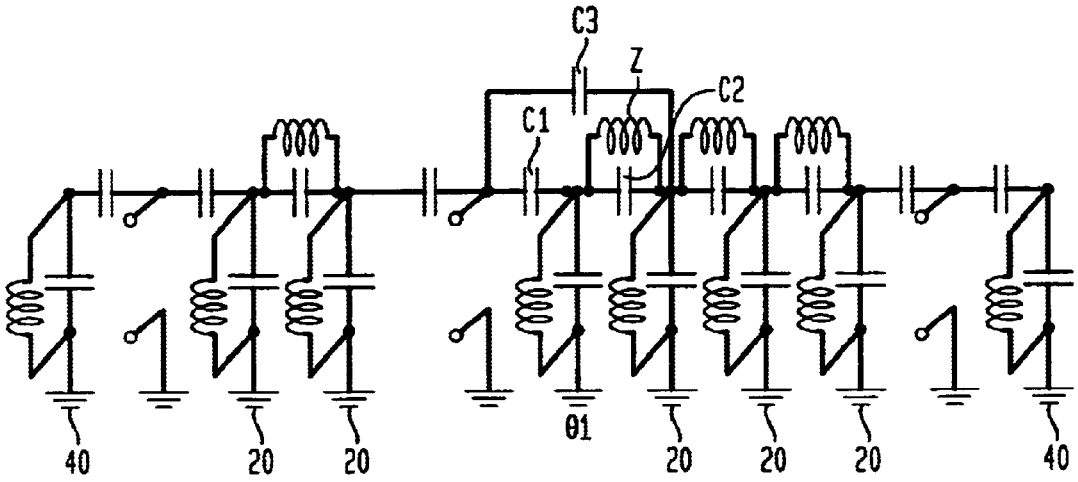
Figure 7J:
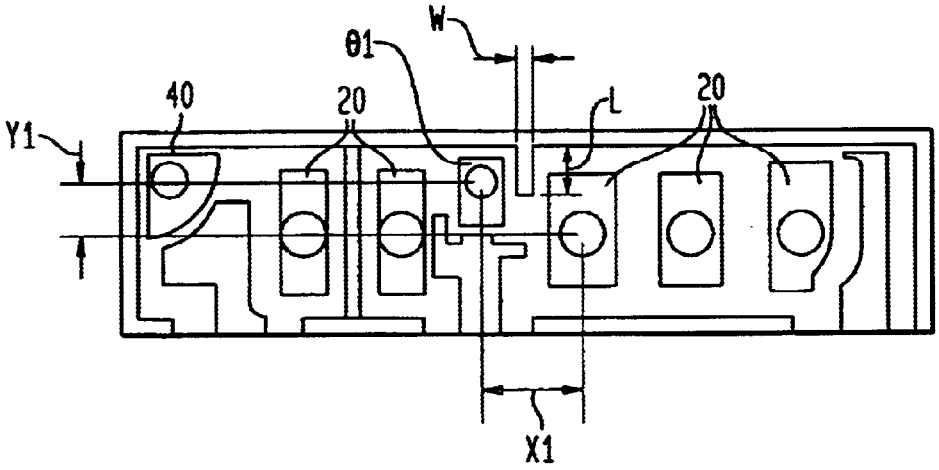
Figure 7K:
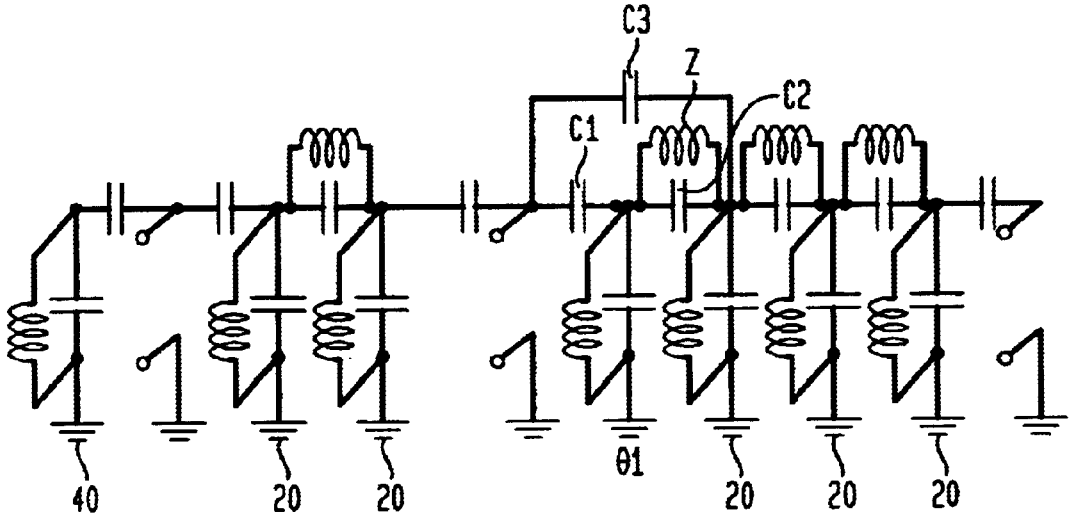

FIG. 7C and corresponding equivalent circuit in FIG. 7D show 8 transmission poles 20 and a resonator θ1, which acts as both a transmission pole and a trap resonator due to the relationship of capacitance couplings C1, C2 and C3 and inductance Z. FIG. 7E and corresponding equivalent circuit in FIG. 7D show 7 transmission poles 20, a trap resonator 40 and a resonator θ1, which acts as both a transmission pole and a trap resonator due to the relationship of capacitance couplings C1, C2 and C3 and inductance Z. FIG. 7G and corresponding equivalent circuit in FIG. 7H show 5 transmission poles 20, 2 trap resonators 40 and resonator θ1, which acts as both a transmission pole and a trap resonator due to the relationship of capacitance couplings C1, C2 and C3 and inductance Z. FIG. 7J and corresponding equivalent circuit in FIG. 7K show 5 transmission poles 20, a trap resonator 40 and a resonator θ1, which acts as both a transmission pole and a trap resonator due to the relationship of capacitance couplings C1, C2 and C3 and inductance Z.

It should be noted that capacitance couplings C1, C2 and C3 work in a manner similar to that described for FIG. 4B above to allow for a resonator θ1 to wok as both a transmission pole and a trap resonator to allow for a reduced-size duplexer.

Figure 8A:
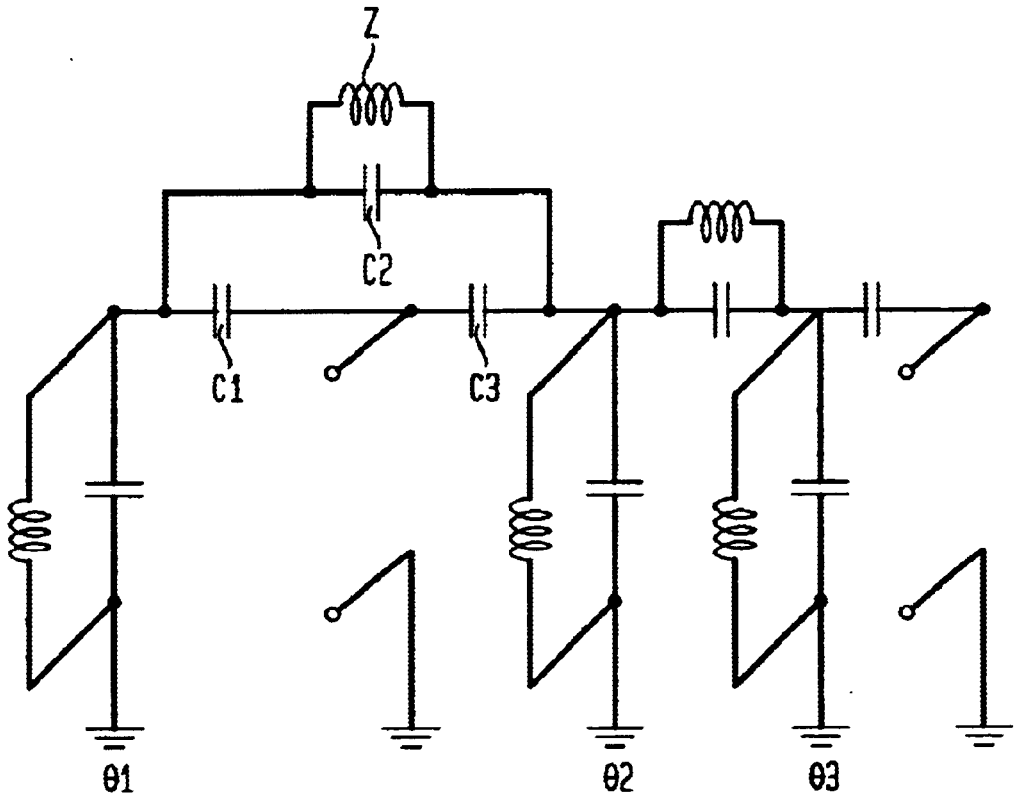
FIG. 8 illustrates another preferred embodiment of a printed pattern for a filter designed to perform as the equivalent circuit of FIG. 3. This filter has two (2) transmission poles and one (1) trap resonator, but it can work as a filter with three (3) transmission poles and one (1) trap resonator.
Figure 8B:
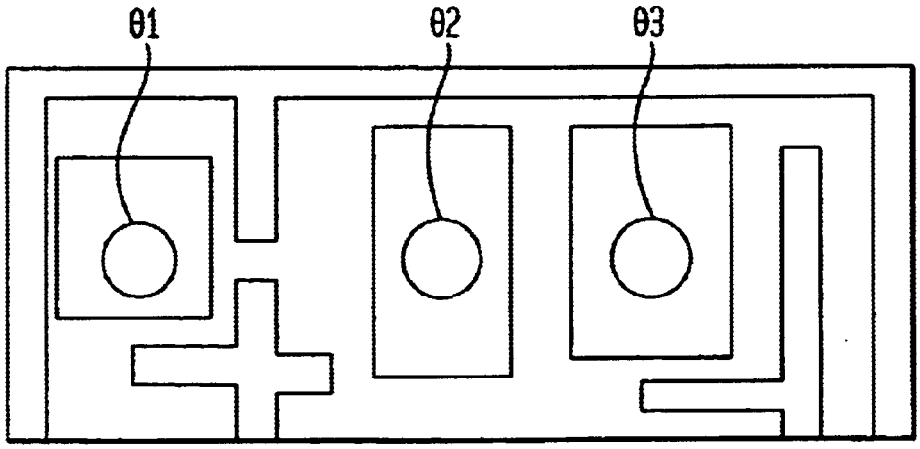
Figure 9:
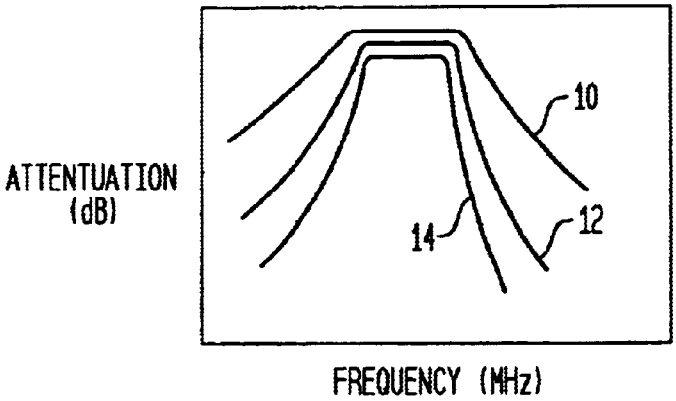
FIG. 9 (PRIOR ART)
FIG. 9 illustrates the increased sharpness of the band pass response of a dielectric ceramic filter as the number of holes in the filter increase.
Figure 10:
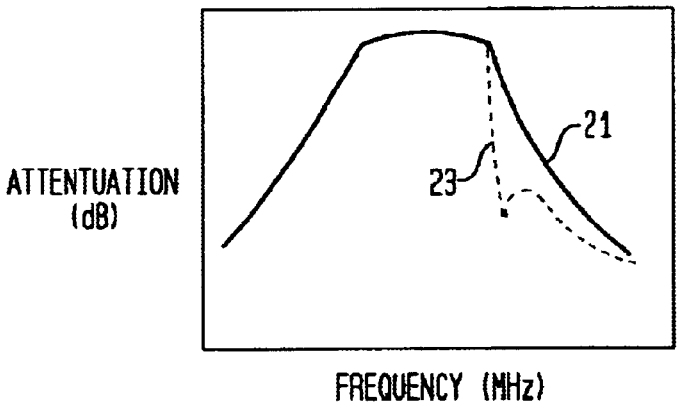
FIG. 10 (PRIOR ART)
FIG. 10 illustrates the effectiveness of traps in removing high end frequencies.
Figure 11:
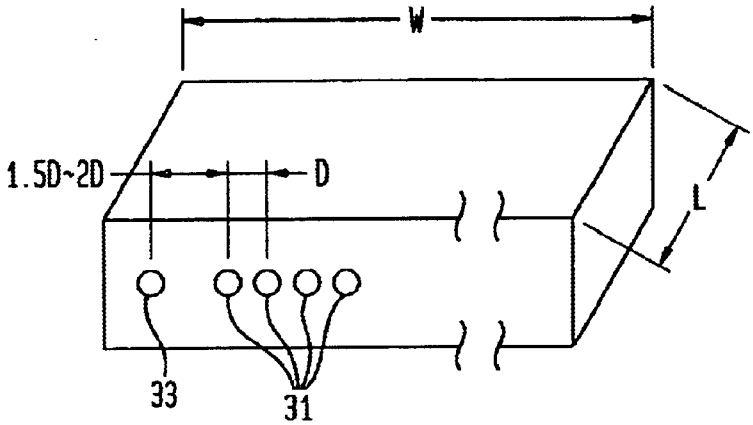
FIG. 11 (PRIOR ART)
FIG. 11 is representative of the spacing between holes and hole and trap on a conventional ceramic block filter.

FIG. 8A illustrates another embodiment of the present invention, with FIG. 8B showing the equivalent circuit. This figure has two (2) transmission poles and one (1) trap resonator, but it can work as a filter with three (3) transmission poles and one (1) trap resonator.

In particular, FIG. 8A shows resonators θ1, θ2 and θ3, with θ1 acting as both a transmission pole and a trap resonator because of the relationship between C1, C2 and C3 as described above.

According to the above results, this new filter technology can be applied to many filters and duplexers which are of a smaller size with higher electrical performance than currently available filters. The foregoing merely illustrates the principles of the present invention. Those skilled in the art will be able to devise various modifications, which although not explicitly described or shown herein, embody the principles of the invention and are thus within its spirit and scope.

What is claimed is:

1. A filter, comprising:

a block of dielectric material having a top surface, a bottom surface, two opposing first side-walls connecting said top surface to said bottom surface along the width of said block and two opposing second side-walls connecting said top surface to said bottom surface along the height of said block;

two input/output pads on one of said first side walls;

at least three holes extending along the width of said block and extending through said block from said top surface to said bottom surface, wherein at least one of said at least three holes which is located at the end of the at least three holes is offset, or off a line bisecting the remaining holes of the at least three holes;

conductive material substantially converting said bottom surface said first and second side-wall surfaces and said inner surfaces of said at least three holes;

each of said holes have patterns of conductive material on said top surface, surrounding said holes;

said offset hole having a center which is a distance Y1 from a center of a hole adjacent to the offset hole, said distance Y1 being perpendicular to the filter's first side walls;

said center of said offset hole is a distance X1, from the center of said adjacent hole, said distance X1 being parallel to the filter's first side walls;

a first pattern of conductive material between said offset hole and the adjacent hole, where said first pattern comprises a first arm of conductive material parallel to an edge of the conductive material of the offset hole and parallel to the filter's first side walls, a second arm of conductive material perpendicular to said first arm of conductive material, and a third arm of conductive material parallel to the first arm of conductive material and perpendicular to the second arm of conductive material said first pattern of conductive material is connected to the first of said input/output pads on one of said first side walls;

said edge of said offset hole's pattern of conductive material has a capacitance C2 from the edge of conductive material surrounding the adjacent hole, where C2 is the capacitance between two opposite edges of said offset hole's pattern of conductive material and said adjacent hole's pattern of conductive material;

where said offset holes is next to the first arm of conductive material where a capacitance C1 is provided between the conductive material surrounding said offset hole and the first arm of conductive material;

a second pattern conductive material opposite the first pattern of material, where said second pattern has a width, W, and a length, L, said second pattern is connected to the conductive material on one of said first side walls; and a capacitance C3 which is the capacitance between said pattern of hole adjacent to said offset hole and said first pattern is provided; and a third pattern of conductive material between a fifth and a sixth hole where said third pattern is connected to said second input/output pad.

2. The filter of claim 1 wherein W: 0.5 mm≧W≧0.1 mm, L: 3.0 mm≧L≧0.5 mm, X1: 4.0 mm≧X1≧1.0 mm and Y1: 2.0 mm≧Y1 2.0 mm≧0 mm.

3. The filter of claim 1 or 2 wherein C1>C3>C2.

4. A duplexer filter comprising:

a block of dielectric material having a top surface, a bottom surface, two opposing side-walls connecting said top surface to said bottom surface along the width of said block and two opposing side-walls connecting said top surface to said bottom surface along the height of said block, said block having a higher band and a lower band;

three input/output pads on one of said side-walls;

multiple holes spaced along the width of said block and extending through said block from said top surface to said bottom surface, wherein a first hole is located at a first location and where said first hole has a center which is offset or off a line bisecting the remaining holes;

conductive material substantially covering said bottom surface said side-wall surfaces and said inner surfaces of said holes;

said center of said offset hole is a distance Y1 from a center of a hole adjacent to said offset hole, said distance Y1 being perpendicular to the width of the filter's side walls;

said center of said offset hole is a distance X1, from the center of said adjacent hole said distance X1 being parallel to the width of the filter's side walls;

a first pattern of conductive material connected to one of side walls, where said first pattern is located between said first offset hole and the next adjacent hole to the first offset hole and has a width W and a length L;

a second pattern of conductive material connected to said first input/output pad, where said second pattern is located between a non-offset hole of lower band and the next adjacent non-offset hole of higher band;

where said first offset hole is next to the second pattern of conductive material with a capacitance C1 between the conductive material surrounding said first offset hole and the second pattern of conductive material;

a second capacitance C2 which is the capacitance between the pattern of said next adjacent hole to said first offset hole and said conductive material surrounding said first offset hole; and a third capacitance C3 which is the capacitance between said second pattern of conductive material and said pattern of said next adjacent hole to said first offset hole.

5. The filter of claim 4 wherein at least two of said holes are transmission poles and the number of transmission poles is at least two in each of a higher and lower band of frequencies.

6. The filter of claim 5 wherein the frequency of the offset hole at the center of said duplexer filter is nearly equal to that of a higher band of frequencies.

7. The filter of claim 6 wherein W: 0.5 mm≧W≧0.1 mm, L: 3.0 mm≧L≧0.5 mm, X1: 4.0 mm≧X1≧1.0 mm and Y1: 2.0 mm≧Y1≧0 mm.

8. The filter of claim 5 wherein W: 0.5 mm≧W≧0.1 mm, L: 3.0 mm≧L≧0.5 mm, X1: 4.0 mm≧X1≧1.0 mm and Y1: 2.0 mm≧Y1≧0 mm.

9. The filter of claim 4 wherein the frequency of the offset hole at the center of said duplexer filter is nearly equal to that of a higher band of frequencies.

10. The filter of claim 9 wherein W: 0.5 mm≧W≧0.1 mm, L: 3.0 mm≧L≧0.5 mm, X1: 4.0 mm≧X1≧1.0 mm and Y1: 2.0 mm≧Y1≧0 mm.

11. The filter of claim 4 wherein W: 0.5 mm≧W≧0.1 mm, L: 3.0 mm≧L≧0.5 mm, X1: 4.0 mm≧X1≧1.0 mm and Y1: 2.0 mm≧Y1≧0 mm.

12. The filter of claim 4, 5, 9, 6, 11, 8, 10 or 7 wherein C1>C3>C2.

13. The filter of claim 4 where said offset holes has a right and left side with reference to the top surface, and wherein the offset hole has a line of four holes to the right of said offset hole and four holes to the left said offset hole.

14. The filter of claim 4 where there are two offset holes, each of said holes having a right and left side with reference to the top surface, the first offset hole having three holes to the left and three non-offset holes to the right of its location, with said second offset hole to the right of the last of said non-offset holes.

15. The filter of claim 4 where there are three offset holes, each of said holes having a right and left side with reference to the top surface, with one offset hole on each of the two ends of said filter and the third to the right of two non-offset holes and to the left of three non-offset holes.

16. The filter of claim 4 where the filter has a right end and a left end with reference to the top surface, and where there are two offset holes, each of the holes having a right side and a left side with reference to the top surface, with one offset hole on the left end of said filter and the offset hole having two non-offset holes to the left of said second offset hole and three non-offset holes to the right of said second offset hole.

* * * * *